US007663581B2

(12) United States Patent
Kwak

(10) Patent No.: US 7,663,581 B2
(45) Date of Patent: Feb. 16, 2010

(54) LIGHT EMITTING PANEL AND LIGHT EMITTING DISPLAY

(75) Inventor: Won-Kyu Kwak, Suwon-si (KR)

(73) Assignee: Samsung Mobile Display Co., Ltd., Giheung-Gu, Yongin, Gyunggi-Do (KR)

( * ) Notice: Subject to any disclaimer, the term of this patent is extended or adjusted under 35 U.S.C. 154(b) by 537 days.

(21) Appl. No.: 11/265,193

(22) Filed: Nov. 3, 2005

(65) Prior Publication Data

US 2006/0103608 A1 May 18, 2006

(30) Foreign Application Priority Data

Nov. 17, 2004 (KR) ..... 10-2004-0093926

(51) Int. Cl.
*G09G 3/30* (2006.01)
*G09G 3/32* (2006.01)

(52) U.S. Cl. ..... 345/82; 345/77; 345/78; 345/79; 345/83

(58) Field of Classification Search ..... 345/76–80, 345/82–83, 964; 315/169.3
See application file for complete search history.

(56) References Cited

U.S. PATENT DOCUMENTS

| | | | | |
|---|---|---|---|---|
| 7,221,092 | B2 * | 5/2007 | Anzai et al. | 313/506 |
| 2003/0112208 | A1 * | 6/2003 | Okabe et al. | 345/82 |

FOREIGN PATENT DOCUMENTS

| | | | |
|---|---|---|---|
| JP | 09-138659 | A | 5/1997 |
| JP | 2002-215093 | A | 7/2002 |
| JP | 2002-244619 | A | 8/2002 |
| JP | 2003-050564 | A | 2/2003 |
| JP | 2003-122306 | A | 4/2003 |
| JP | 2003-150082 | A | 5/2003 |
| JP | 2003-150104 | A | 5/2003 |
| JP | 2003-216100 | A | 7/2003 |
| JP | 2003-255899 | A | 9/2003 |
| JP | 2004-029791 | A | 1/2004 |
| WO | 01-06484 | A | 1/2001 |
| WO | 01-24153 | A | 4/2001 |
| WO | 03-077231 | A | 9/2003 |

* cited by examiner

*Primary Examiner*—Amr Awad
*Assistant Examiner*—Andre Matthews
(74) *Attorney, Agent, or Firm*—Robert E. Bushnell, Esq.

(57) ABSTRACT

A light emitting display increases the lifetime of a light emitting element by reverse biasing the light emitting element without using an additional power source and a power source line. The light emitting element is reverse biased without using the power source and the power source line for the reverse bias because a low level light emitting scan signal is used. The aperture ratio, contrast ratio, and lifetime of the light emitting display are increased.

15 Claims, 10 Drawing Sheets

LIGHT EMITTING PANEL AND LIGHT EMITTING DISPLAY

CLAIM OF PRIORITY

This application makes reference to, incorporates the same herein, and claims all benefits accruing under 35 U.S.C. §119 from an application for LIGHT EMITTING PANEL AND LIGHT EMITTING DISPLAY earlier filed in the Korean Intellectual Property Office on 17 Nov. 2004 and there duly assigned Serial No. 10-2004-0093926.

BACKGROUND OF THE INVENTION

1. Field of the Invention

The present invention relates to a light emitting display. More particularly, the present invention relates to an Organic Light Emitting Diode (OLED) display using the electro-luminescence of an organic material.

2. Description of the Related Art

In general, an Organic Light Emitting Diode (OLED) display electrically excites a fluorescent organic material to emit light and visualize an image by voltage programming or current programming N×M organic light emitting cells.

Such organic light emitting cells are called Organic Light Emitting Diodes (OLEDs) because they have diode characteristics. An OLED includes anode (ITO), organic thin film, and cathode (metal) layers. The organic thin film has a multi-layer structure, including an EMitting Layer (EML), an Electron Transport Layer (ETL), and a Hole Transport Layer (HTL), so as to balance electrons and holes and thereby enhance light emitting efficiency. Furthermore, the organic thin film separately includes an Electron Injection Layer (EIL) and a Hole Injection Layer (HIL). The N×M organic light emitting cells arranged in a matrix format form an OLED display panel.

A pixel of N×M pixels (i.e., a pixel positioned at the first column and the first row) of an active matrix OLED display includes subpixels and these subpixels respectively include OLEDs emitting red (R), green (G), and blue (B) light. In a striped structure of subpixels, the subpixels are coupled to different data lines, and are coupled to a common scan line.

A driving transistor is arranged between a source voltage and an anode of the the red OLED and transmits a current for light emission to the red OLED. A cathode of the red OLED is coupled to a voltage VSS that is lower than the source voltage. A current passing through the driving transistor is controlled by a data voltage supplied by a switching transistor. A capacitor is coupled to a source and a gate of the driving transistor and sustains a supplied voltage. A gate of the driving transistor is coupled to the scan line through which a scan signal containing on/off information is transmitted, and a source of the driving transistor is coupled to a data line through which a data voltage for the red subpixel is transmitted.

A data voltage VDATA from the red data line is supplied to the gate of the red driving transistor when the switching transistor is turned on in response to a selection signal supplied to the gate of the transistor. A current IOLED flows to the red transistor, the current corresponding to the voltage VGS between the gate and the source and stored by the capacitor, and the red OLED emission corresponds to the current IOLED. The current IOLED flowing through the red OLED is given by Equation 1 as follows.

$$I_{OLED} = \frac{\beta}{2}(V_{GS} - V_{TH})^2 = \frac{\beta}{2}(V_{DD} - V_{DATA} - |V_{TH}|)^2 \quad \text{Equation 1}$$

As shown by Equation 1, the current corresponding to the supplied data voltage is supplied to the red OLED, and the red OLED emits light with a brightness corresponding to the supplied current.

The supplied data voltage has multiple-stage values within a predetermined range so as to display gray scales.

As described above, in the OLED display, one pixel includes subpixels, and each subpixel includes a driving transistor, a switching transistor, and a capacitor for driving an OLED. A data line for transmitting data signals and a source line for transmitting the source voltage are formed on each subpixel. Accordingly, problems of line arrangement in a pixel area and aperture ratio reduction in a light emitting area occur since more lines are required to drive the pixel. Accordingly, an arrangement having a reduced number of lines and elements to drive the pixels is needed.

SUMMARY OF THE INVENTION

An object of the present invention is to provide a light emitting display having an increased aperture ratio and yield and effectively using panel space by reducing the number of lines and elements, and to provide a light emitting display having an increased lifetime of its light emitting elements.

These and other objects of the present invention are achieved by providing a light emitting display panel including: a plurality of first signal lines adapted to transmit a first signal; a plurality of second signal lines and a plurality of third signal lines adapted to respectively transmit a second signal and a third signal; a plurality of fourth signal lines adapted to transmit a fourth signal, the plurality of fourth signal lines arranged to cross the first signal lines, the second signal lines, and the third signal lines; and a plurality of pixels respectively corresponding to crossing points of the first signal lines, the second signal lines, the third signal lines, and the fourth signal lines, each pixel including: a pixel driver adapted to output a first current corresponding to the fourth signal in response to the first signal; a first light emitting element adapted to selectively emit light corresponding to the first current outputted from the pixel driver in response to the second signal; a second light emitting element adapted to selectively emit light corresponding to the first current outputted from the pixel driver in response to the third signal; a first switch adapted to control the first current outputted from the pixel driver to the first light emitting element in response to the second signal; a second switch adapted to control the first current outputted from the pixel driver to the second light emitting element in response to the third signal; a third switch adapted to control a second current outputted from the first light emitting element to the third signal line in response to the second signal; and a fourth switch adapted to control the second current outputted from the second light emitting element to the second signal line in response to the third signal.

The first light emitting element preferably includes a first electrode electrically coupled to the first and third switches, and a second electrode electrically coupled to a first reference voltage; the second light emitting element preferably includes a first electrode electrically coupled to the second and fourth switches, and a second electrode electrically coupled to the first reference voltage; the second signal is adapted to output a first level to turn on the first switch and a second level to turn on the third switch; the third signal is adapted to output the first level to turn on the second switch and the second level to turn on the fourth switch; and the first level of the second and third signals is less than the first reference voltage.

The first level of the second and third signals is preferably less than the second level of the second and third signals.

These and other objects of the present invention are also achieved by providing a light emitting display device including: a plurality of scan lines adapted to transmit a scan signal; a plurality of first light emission control lines and a plurality of second light emission control lines adapted to respectively transmit a first light emission control signal and a second light emission control signal; a plurality of data lines adapted to transmit a data signal, the plurality of data lines arranged to cross the scan lines, the first light emission control lines, and the second light emission control lines; a plurality of pixels respectively corresponding to crossing points of the scan lines, the first light emission control lines, the second light emission control lines, and the data lines; a scan driver adapted to transmit the scan signal to the scan lines; a light emission control driver adapted to respectively transmit the first light emission control signal and the second light emission control signal to the first light emission control lines and the second light emission control lines; and a data driver adapted to transmit the data signal to the data lines; wherein each pixel includes: a pixel driver adapted to output a first current corresponding to the data signal in response to the scan signal; a first light emitting element adapted to selectively emit light corresponding to the first current outputted from the pixel driver in response to the first light emission control signal; a second light emitting element adapted to selectively emit light corresponding to the first current outputted from the pixel driver in response to the second light emission control signal; a first switch adapted to control the first current outputted from the pixel driver to the first light emitting element in response to the first light emission control signal; a second switch adapted to control the first current outputted from the pixel driver to the second light emitting element in response to the second light emission control signal; a third switch adapted to control a second current outputted from the first light emitting element to the second light emission control line in response to the first light emission control signal; and a fourth switch adapted to control the second current outputted from the second light emitting element to the first light emission control line in response to the second light emission control signal.

The first light emitting element preferably includes a first electrode electrically coupled to the first and third switches, and a second electrode electrically coupled to the first reference voltage; the second light emitting element preferably includes a first electrode electrically coupled to the second and fourth switches, and a second electrode electrically coupled to the first reference voltage; the second signal is adapted to output a first level to turn on the first switch and a second level to turn on the third switch; the third signal is adapted to output the first level to turn on the second switch and the second level to turning on the fourth switch; and the first level of the second and third signals is less than the first reference voltage.

The first level of the second and third signals is preferably less than the second level of the second and third signals.

The first switch preferably includes a first transistor having a gate electrically coupled to the second signal line and a source electrically coupled to the pixel driver; the second switch preferably includes a second transistor having a gate electrically coupled to the third signal line and a source electrically coupled to the pixel driver; the third switch preferably includes a third transistor having a gate electrically coupled to the second signal line and a drain electrically coupled to the third signal line; and the fourth switch preferably includes a fourth transistor having a gate electrically coupled to the third signal line and a drain electrically coupled to the second signal line.

The first and second transistors preferably comprise p-type transistors and the third and fourth transistors comprise n-type transistors.

These and other objects of the present invention are further achieved by providing a light emitting display panel including: a plurality of scan lines adapted to transmit a scan signal; a plurality of first light emission control lines and a plurality of second light emission control lines adapted to respectively transmit a first light emission control signal and a second light emission control signal; a plurality of data lines adapted to transmit a data signal, the plurality of data lines arranged to cross the scan lines, the first light emission control lines, and the second light emission control lines; and a plurality of pixels respectively corresponding to crossing points of the scan lines, the first light emission control lines, the second light emission control lines, and the data lines; wherein each pixel includes: a pixel driver adapted to output a first current corresponding to the data signal in response to the scan signal; a first light emitting element adapted to selectively emit light corresponding to the first current outputted from the pixel driver in response to the first light emission control signal; a second light emitting element adapted to selectively emit light corresponding to the first current outputted from the pixel driver in response to the second light emission control signal; a first transistor having a gate electrically coupled to the first light emission control line, a source electrically coupled to the pixel driver, and a drain electrically coupled to the first light emitting element; a second transistor having a gate electrically coupled to the second light emission control line, a source electrically coupled to the pixel driver, and a drain electrically coupled to the second light emitting element; a third transistor having a gate electrically coupled to the first light emission control line, a drain electrically coupled to the second light emission control line, and a source electrically coupled to the first light emitting element; and a fourth transistor having a gate electrically coupled to the second light emission control line, a drain electrically coupled to the first light emission control line, and a source electrically coupled to the second light emitting element.

The first current preferably flows from the pixel driver to the first light emitting element in response to the first transistor being turned on; and the second current preferably flows from the first light emitting element to the second light emission control line in response to the third transistor being turned on.

The first current preferably flows from the pixel driver to the second light emitting element in response to the second transistor being turned on; and the second current preferably flows from the second light emitting element to the first light emission control line in response to the fourth transistor being turned on.

The first and third transistors are preferably not turned on concurrently; and the second and fourth transistors are preferably not turned on concurrently.

The first and second transistors preferably comprise p-type transistors, and the third and fourth transistors comprise n-type transistors.

These and other objects of the present invention are still further achieved by providing a method of driving a light emitting display device, the driving method including: transmitting a first signal with a plurality of first signal lines; respectively transmitting a second signal and a third signal with a plurality of second signal lines and a plurality of third signal lines; transmitting a fourth signal with a plurality of fourth signal lines, the plurality of fourth signal lines being arranged to cross the pluralities of first, second, and third signal lines; providing a plurality of pixels respectively having a first light emitting element and a second light emitting element, the plurality of pixels respectively corresponding to an area where the first, second, third, and fourth signal lines cross: controlling a first current corresponding to the fourth signal transmitted to the first light emitting element in response to the second signal; controlling a second current to transmitted from the first light emitting element to third signal lines in response to the third signal; controlling the first current corresponding to the fourth signal transmitted to the second light emitting element in response to the third signal; and controlling the second current transmitted from the second light emitting element to the second signal lines in response to the second signal.

The driving method preferably further includes: controlling the first and second currents in response to the second signal during a first period; and controlling the first and second currents in response to the third signal during a second period.

BRIEF DESCRIPTION OF THE DRAWINGS

A more complete appreciation of the present invention and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
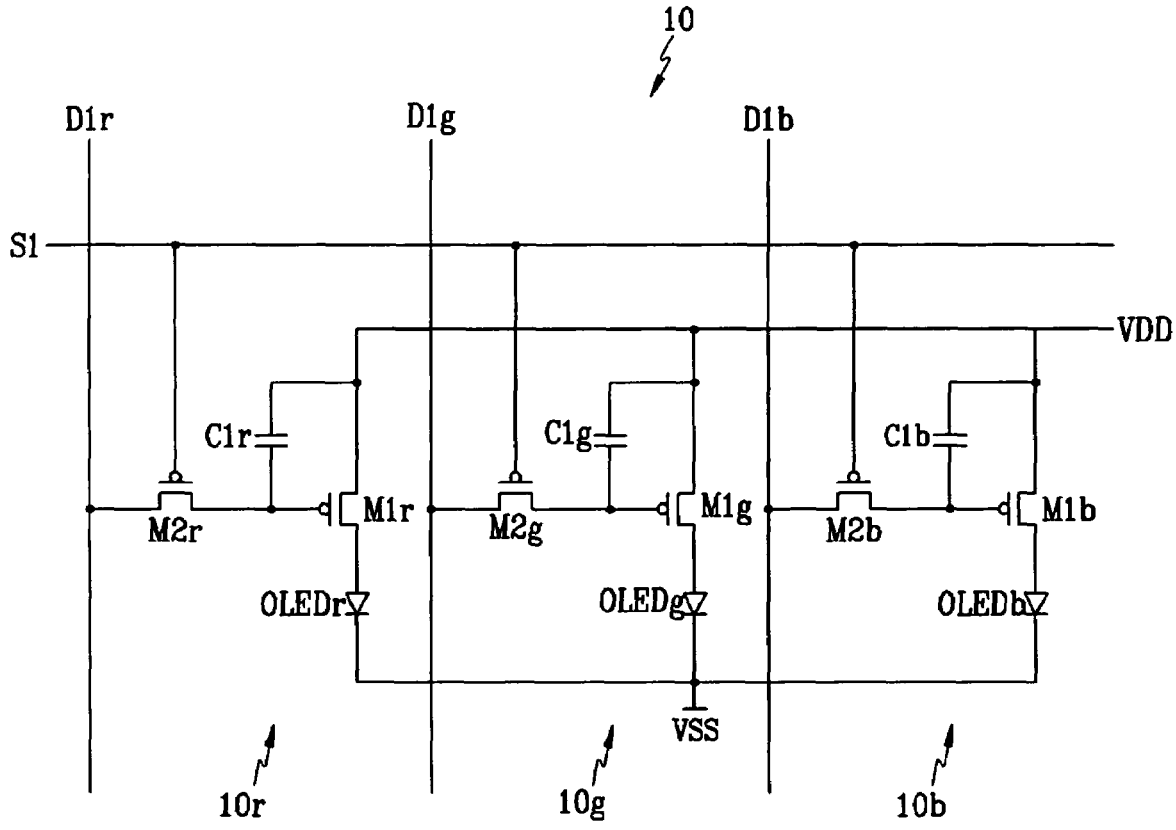
FIG. 1 is a circuit diagram of an equivalent pixel circuit of the first pixel of N×M pixels.

FIG. 1 is a circuit diagram of an equivalent pixel circuit of the first pixel of N×M pixels (i.e., a pixel positioned at the first column and the first row).

As shown in FIG. 1, a pixel 10 includes subpixels 10*r*, 10*g*, and 10*b*, and these subpixels 10*r*, 10*g*, and 10*b* respectively include OLEDr, OLEDg, and OLEDb respectively emitting red (R), green (G), and blue (B) light. In a striped subpixel structure, the subpixels 10*r*, 10*g*, and 10*b* are coupled to different data lines D1*r*, D1*g*, and D1*b*, and are coupled to a common scan line S1.

The operations of these subpixels 10*r*, 10*g*, and 10*b* are the same, and accordingly, only the operation of the subpixel 10*r* has been described below.

A driving transistor M1*r* is arranged between a source voltage VDD and an anode of the OLEDr and transmits a current for light emission to the OLEDr. A cathode of the OLEDr is coupled to a voltage VSS that is lower than the source voltage VDD. A current passing through the driving transistor M1*r* is controlled by a data voltage supplied by a switching transistor M2*r*. A capacitor C1*r* is coupled to a source and a gate of the transistor M1*r* and sustains a supplied voltage. A gate of the transistor M2*r* is coupled to the scan line S1 through which a scan signal containing on/off information is transmitted, and a source of the transistor M2*r* is coupled to the data line D1*r* through which a data voltage for the red subpixel 10*r* is transmitted.

A data voltage VDATA from the data line D1*r* is supplied to the gate of the transistor M1*r* when the switching transistor M2*r* is turned on in response to a selection signal supplied to the gate of the transistor M2*r*. A current IOLED flows to the transistor M1*r*, the current corresponding to a voltage VGS between the gate and the source and stored by the capacitor C1*r*, and the OLEDr emission corresponds to the current IOLED. The current IOLED flowing through OLEDr is given by Equation 1 as follows.

$$I_{OLED} = \frac{\beta}{2}(V_{GS} - V_{TH})^2 = \frac{\beta}{2}(V_{DD} - V_{DATA} - |V_{TH}|)^2 \qquad \text{Equation 1}$$

As shown by Equation 1, the current corresponding to the supplied data voltage is supplied to the OLEDr, and the OLEDr emits light with a brightness corresponding to the supplied current.

The supplied data voltage has multiple-stage values within a predetermined range so as to display gray scales.

As described above, in the OLED display, one pixel 10 includes subpixels 10*r*, 10*g*, and 10*b*, and each subpixel includes a driving transistor, a switching transistor, and a capacitor for driving an OLED. A data line for transmitting data signals and a source line for transmitting the source voltage VDD are formed on each subpixel. Accordingly, problems of line arrangement in a pixel area and aperture ratio reduction in a light emitting area occur since more lines are required to drive the pixel. Accordingly, an arrangement having a reduced number of lines and elements to drive the pixels is needed.

In the following detailed description, only certain exemplary embodiments of the present invention have been shown and described by way of illustration. As those skilled in the art would realize, these embodiments can be modified in various different ways, all without departing from the spirit or scope of the present invention.

Figure 2:
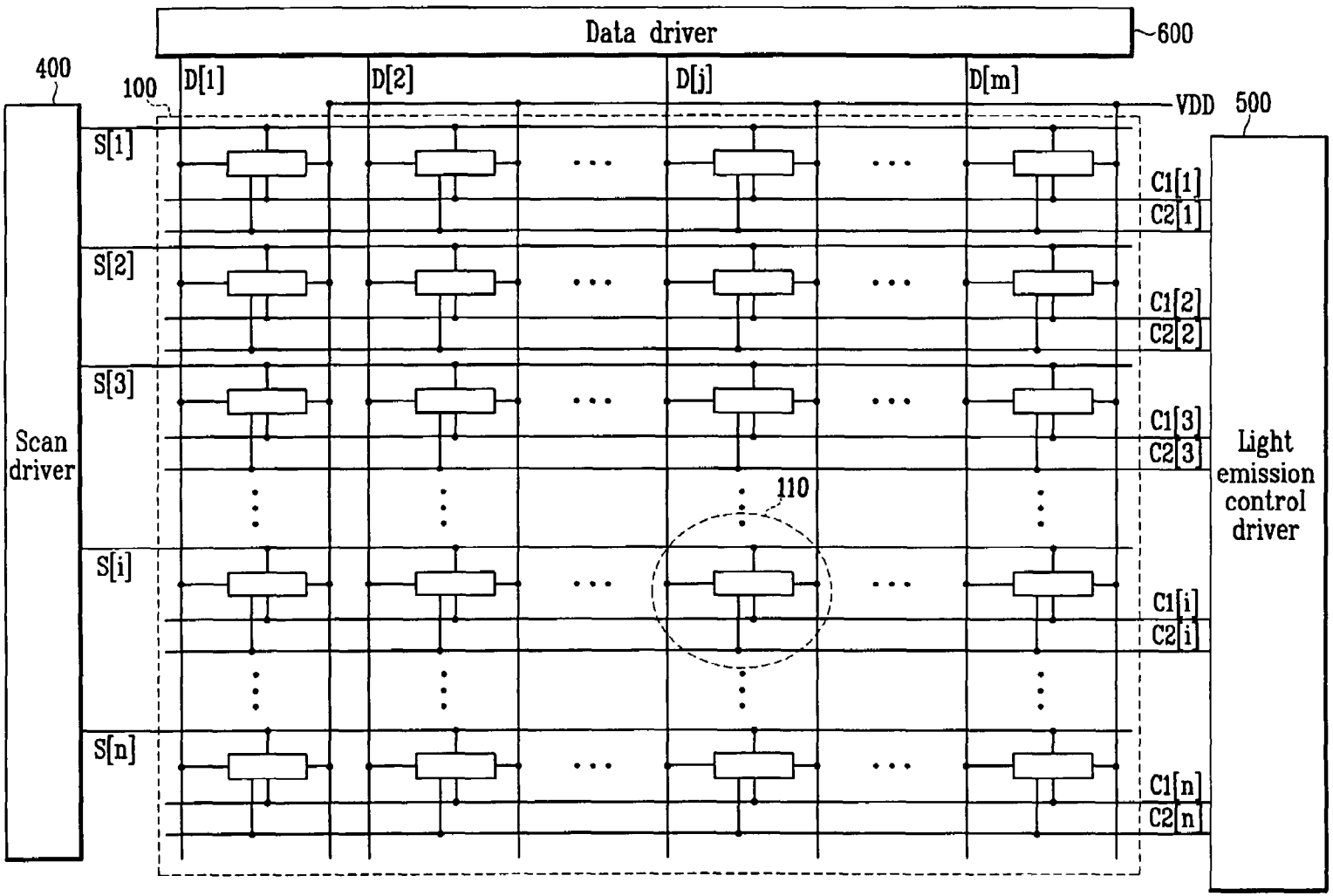
FIG. 2 is a top plan view of a configuration of an OLED display according to a first exemplary embodiment of the present invention.

FIG. 2 is a top plan view of a configuration of an OLED display according to a first exemplary embodiment of the present invention.

As shown in FIG. 2, the OLED display according to the first exemplary embodiment of the present invention includes a display panel 100, a scan driver 400, a light emission control driver 500, and a data driver 600. The display panel 100 includes a plurality of scan lines S[1] to S[n] and a plurality of light emission control lines C1[1] to C2[n] and C2[1] to C2[n] extending in a row direction, a plurality of data lines D[1] to D[m] extending in a column direction, a plurality of power source lines VDD, and a plurality of pixels 110.

A pixel 110 according to the first exemplary embodiment of the present invention includes two OLEDs selected from among red R, green G, and blue B OLEDs. The pixel 110 operates by signals transmitted from the scan lines S[i], the light emission control lines C1[i] and C2[i], and the data lines D[j] such that two OLEDs time-divisionally emit light based on a data signal supplied from one data line D[j]. Note that i is an integer from 1 to n, and j is an integer from 1 to m.

Specifically, the OLED display according to the first exemplary embodiment of the present invention includes two light emission control lines C1[i] and C2[i], and light emission control signals of the respective light emission control lines C1[i] and C2[i] control two OLEDs in one pixel to selectively emit light, so that the two OLEDs in one pixel 110 time-divisionally emit light.

The scan driver 400 generates a scan signal for selecting a scan line and sequentially transmits the scan signal to the scan lines S[1] to S[n] so as to supply a data signal to a pixel of the scan line. The light emission control driver 500 generates a light emission control signal for controlling light emission of OLED1 and OLED2, and sequentially transmits the emission signal to the light emission control lines C1[i] and C2[i]. The data driver 600 supplies the data signal to the data lines D[1] to D[m], the data signal corresponding to the pixel of the scan line to which the scan signal is supplied.

The respective scan driver 400, light emission control driver 500, and data driver 600 are electrically coupled to a substrate on which the display panel 100 is formed. Alternatively, the scan driver 400, the light emission control driver 500, and the data driver 600 can be directly arranged on the substrate in a form of an integrated circuit, or the drivers 400, 500, and 600 can be formed on the same layer on which the data lines, the scan lines, the emission control lines, and the transistors of the pixel circuit are formed on the substrate. In addition, the drivers 400, 500, and 600 can be attached to the substrate by an adhesive in the form of a chip attached to a Tape Carrier Package (TCP), a Flexible Printed Circuit (FPC), or a Tape Automatic Bonding (TAB).

In the first exemplary embodiment of the present invention, one frame is time-divided into two fields so as to time-divisionally operate OLED1 and OLED2 in one pixel. Light is emitted by programming two data among the respective red, green, and blue data into the two fields. That is, the scan driver 400 sequentially transmits the scan signal to the scan line S[i] for each field, the light emission control driver 500 sequentially supplies the light emission control signal to the light emission control lines C1[i] and C2[i] such that the two OLEDs in the pixel emit light for a corresponding field, and the data driver 600 supplies the R, G, B data signals to a corresponding data line D[j] for each field.

The pixel according to the first exemplary embodiment of the present invention is described below with reference to FIG. 3.

Figure 3:
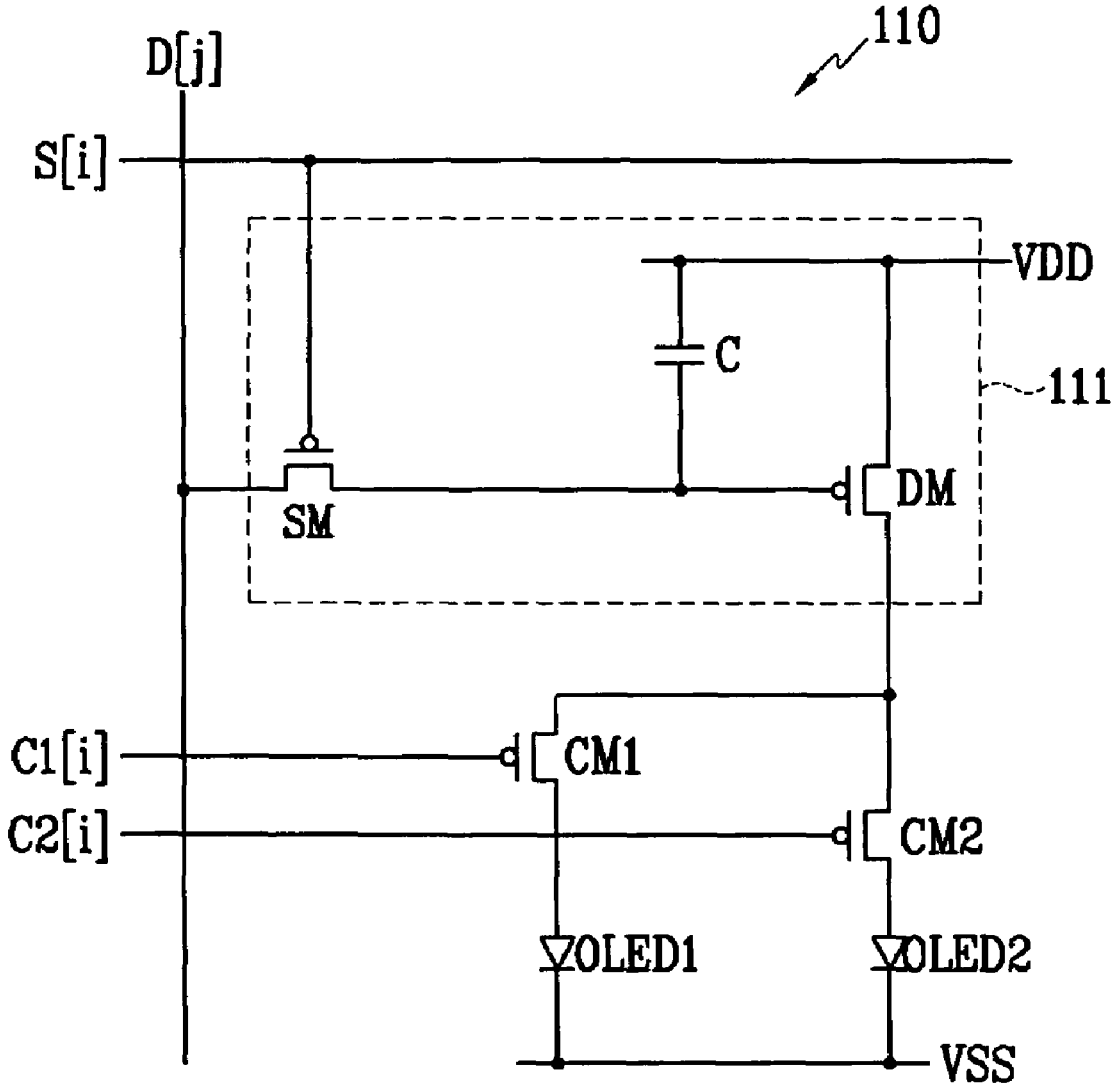
FIG. 3 is a circuit diagram of an equivalent circuit of a pixel of the OLED display of FIG. 2.

FIG. 3 is a circuit diagram of an equivalent circuit of the pixel 110 of the OLED display according to the first exemplary embodiment of the present invention. For a better understanding and ease of description, a pixel in a pixel area in an ith row scan line S[i] and a jth column data line D[j] has been represented. In addition, numerical designations for the light emission control signals supplied on the emission control lines C1[i] and C2[i] have been denoted by the same numerals as the numerals of the emission control lines C1[i] and C2[i], and a numeral for the scan signal supplied to the scan line S[i] have also been denoted as S[i]. The OLED1 and OLED2 of the pixel 110 are two OLEDs among the red R, green G, and blue B OLEDs. In FIG. 3, a driving transistor DM, a switch transistor SM, and control transistors CM1 and CM2 in the pixel 110 are illustrated as p-channel transistors.

As shown in FIG. 3, the pixel 110 includes a pixel driver 111, OLED1 and OLED2, and transistors CM1 and CM2 controlling OLED1 and OLED2 to selectively emit light.

The pixel driver 111 coupled to the scan line S[i] and data line D[j] generates a current to be supplied to OLED1 and OLED2 in response to the data signal transmitted from the data line D[j]. In addition, the pixel driver 111 according to the first exemplary embodiment of the present invention includes two transistors and a capacitor (i.e., a transistor SM, a transistor DM, and a capacitor C). In further detail, the transistor SM has a source coupled to the data line D[j] and a gate coupled to the scan line S[i]. The transistor DM has a source coupled to a source voltage VDD, and a gate coupled to a drain of the transistor SM. A capacitor C is coupled between the gate and the source of the transistor DM.

The transistor CM1 having a source coupled to a drain of the transistor DM, a drain coupled to an anode of the OLED1, and a gate coupled to the light emission control line C1[i] is turned on in response to the light emission control signal C1[i] to transmit the current outputted by the transistor DM to the anode of the OLED1 by being turned on in response to the light emission control signal C1[i]. The transistor CM2 having a source coupled to the drain of the transistor DM, a drain coupled to an anode of the OLED2, and a gate coupled to the light emission control line C2[i] is turned on in response to the light emission control signal C2[i] to transmit the current outputted from the transistor DM to the anode of the OLED2.

The anodes of OLED1 and OLED2 are respectively coupled to the drains of the transistors CM1 and CM2, and cathodes thereof are coupled to a reference voltage Vss that is less than the source voltage VDD. A negative voltage or a ground voltage is used for the reference voltage Vss.

A method of driving the OLED display according to the first exemplary embodiment of the present invention is described below with reference to FIG. 4.

Figure 4:
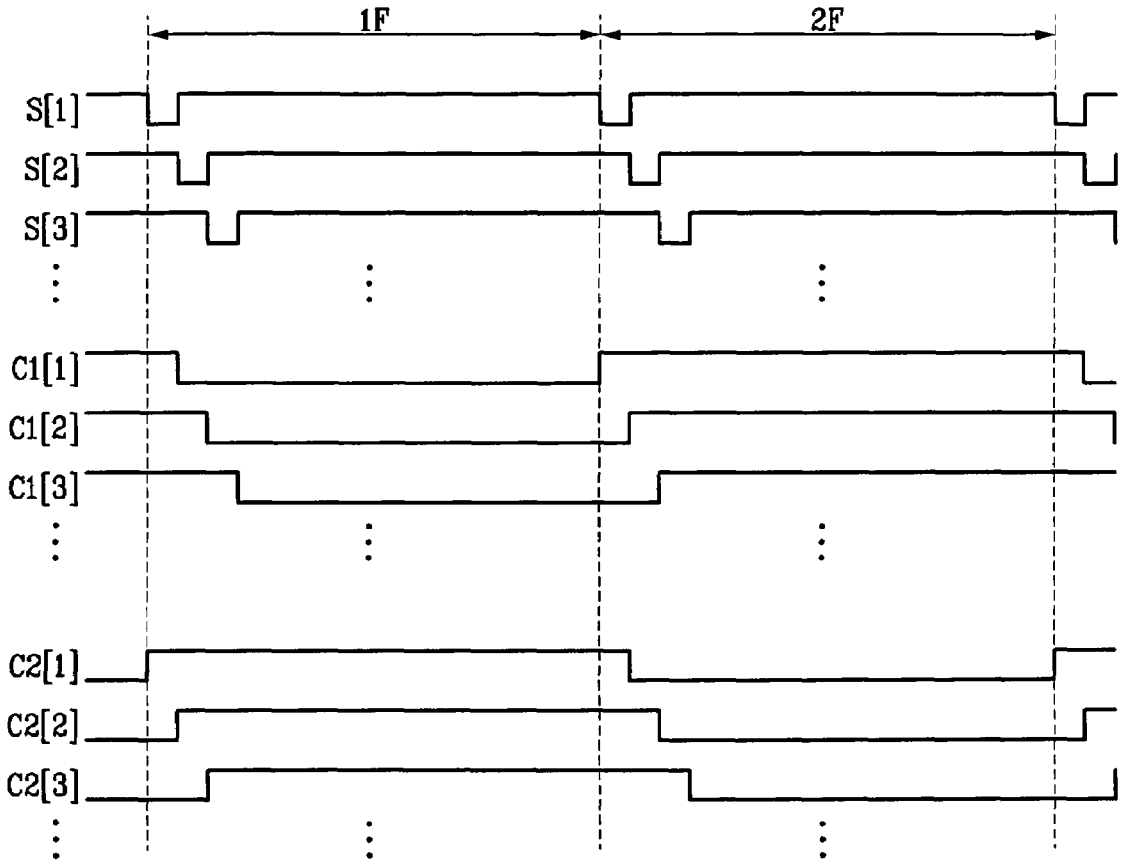
FIG. 4 is a signal timing diagram of the OLED display according to the first exemplary embodiment of the present invention.

FIG. 4 is a signal timing diagram of the OLED display according to the first exemplary embodiment of the present invention.

As shown in FIG. 4, one frame is divided into two fields 1F and 2F when the OLED display according to the first exemplary embodiment of the present invention is operated, and scan signals S[1] to S[n] are sequentially supplied in the respective fields 1F and 2F. The OLED1 and OLED2 share the pixel driver 111 and emit light during a period corresponding to one field. In addition, the fields 1F and 2F can be respectively defined depending on each line. In FIG. 4, the fields 1F and 2F are illustrated on the basis of the scan line S[1] in the first line, and hereinafter, an operation of the display device is described on the basis of the scan line S[1] in the first line.

In the first field 1F, when a low level scan signal is supplied on the present current scan line S[1], the transistor SM is turned on, and then a data voltage Vdata transmitted through the data line D[j] is supplied to the gate of the transistor DM (i.e., an end of the capacitor C). Therefore, a voltage corresponding to a difference between the source voltage VDD and the data voltage Vdata is stored in the capacitor C. In other words, a voltage VGS supplied between the gate and the source of the transistor DM is stored in the capacitor C, and the current IOLED corresponding to the stored voltage VGS flows though the drain of the transistor DM.

Then, when the light emission control signal C1[1] is at a low level, the transistor CM1 is turned on, the current IOLED flowing through the drain of the transistor DM is transmitted to the anode of the OLED1, and then the OLED1 emits light corresponding to the current IOLED. The current IOLED flowing to the OLED1 is given as shown in Equation 1. When the light emission control signal C1[1] is at a low level in the first field 1F and the OLED1 emits light, the light emission control signal C2[1] remains at a high level. Accordingly, the current IOLED is not transmitted to the OLED2 because the transistor CM2 is turned off.

Similarly, in the second field 2F, a low level scan signal is supplied on the current scan line S[1], the transistor SM is turned on, and then a data voltage Vdata transmitted through the data line D[j] is supplied to the gate of the transistor DM (i.e., an end of the capacitor C), the same as in the first field 1F. Therefore, the voltage corresponding to the difference between the source voltage VDD and the data voltage Vdata is stored in the capacitor C. In other words, the voltage VGS supplied between the gate and the source of the transistor DM is stored in the capacitor C, and the current IOLED corresponding to the charged voltage VGS flows though the drain of the transistor DM.

When the light emission control signal C2[1] is at a low level, the transistor CM2 is turned on, and the current IOLED flowing through the drain of the transistor DM is transmitted to the anode of the OLED2. The OLED2 then emits light corresponding to the current IOLED. In the second field 2F, while the light emission control signal C2[1] is at a low level and the OLED2 is emitting light, the light emission control signal C1[1] remains at a high level, the transistor CM1 is turned off, and accordingly, the current IOLED is not transmitted to the OLED1.

However, in the OLED display according to the first exemplary embodiment, space charges are stored between a Hole Transport Layer (HTL) and an EMission Layer (EML) or between an Electron Transport Layer (ETL) and the EML in an organic layer since the current flows in one direction from the anode to the cathode of the OLED. Accordingly, the lifetime of the OLED is reduced by the accumulation of the space charges.

An OLED for preventing the space charges according to a second exemplary embodiment of the present invention and a driving method thereof is described below.

Figure 5:
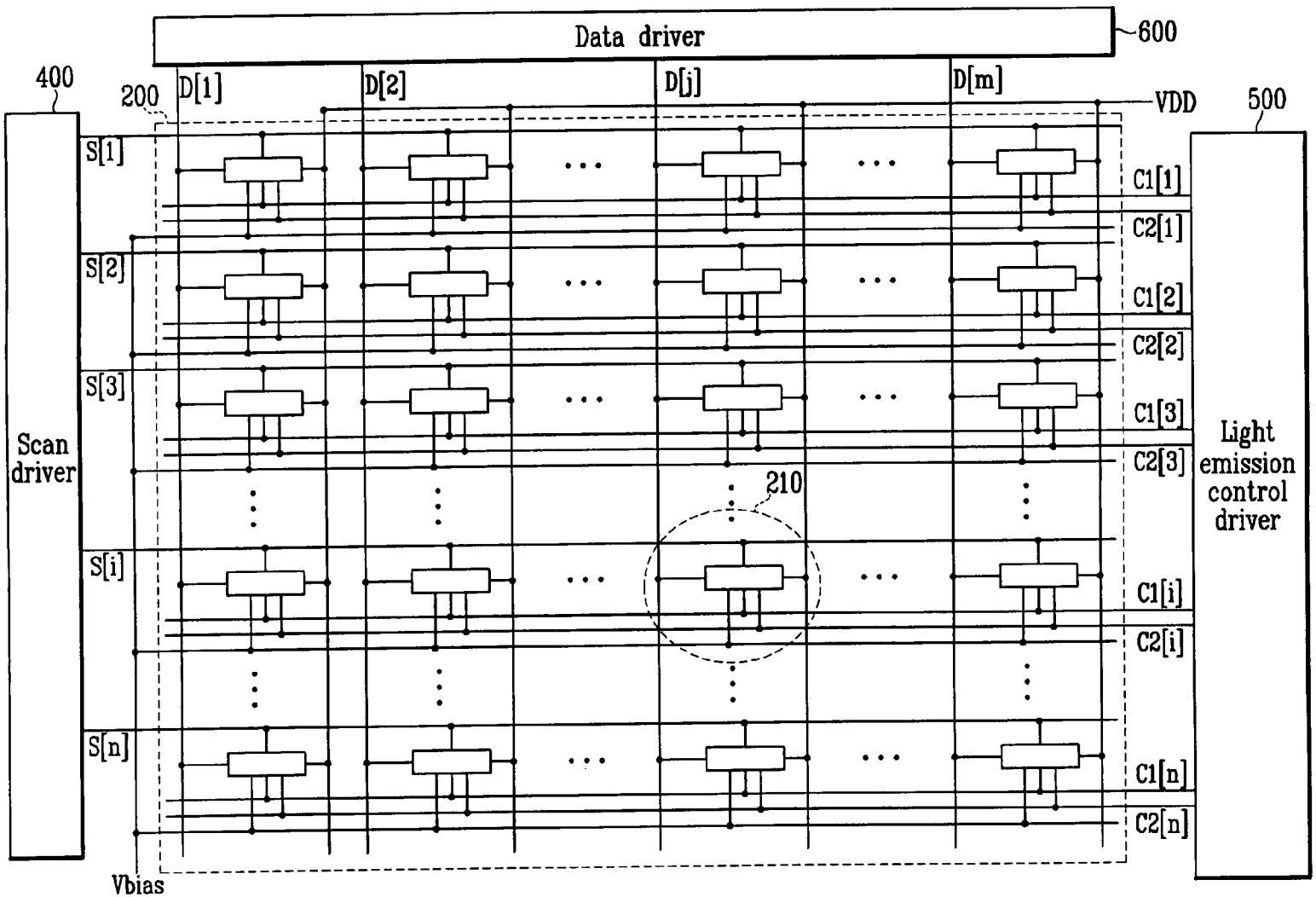
FIG. 5 is a top plan view of a configuration of an OLED display according to a second exemplary embodiment of the present invention.

FIG. 5 is a top plan view of a configuration of an OLED display according to the second exemplary embodiment of the present invention. The OLED display according to the second exemplary embodiment of the present invention is different from the OLED display according to the first exemplary embodiment of the present invention in that the OLED display according to the second exemplary embodiment of the present invention further includes a power source line for supplying a bias voltage Vbias to each pixel.

As shown in FIG. 5, the OLED display according to the second exemplary embodiment of the present invention includes a display panel 200, a scan driver 400, a light emission control driver 500, and a data driver 600. Hereinafter, operations of the scan driver 400, light emission control driver 500, and data driver 600 are the same as those according to the first exemplary embodiment of the present invention, and detailed descriptions thereof have therefore been omitted.

The display panel 200 includes a plurality of scan lines S[1] to S[n] and a plurality of light emission control lines C1[1] to C1[n] and C2[1] to C2[n] extending in a row direction, a plurality of data lines D[1] to D[m], a plurality of power source lines VDD, and a plurality of bias power source lines Vbias extending in a column direction, and a plurality of pixels 210. The pixel 210 operates by signals transmitted from the scan lines S[i], the light emission control lines C1[i] and C2[i], and the data lines D[j] such that two OLEDs time-divisionally emit light based on a data signal supplied from one data line D[j]. The bias voltage Vbias is generally a negative bias voltage which is less than the reference voltage Vss supplied to cathodes of OLEDs OLED1 and OLED2.

Figure 6:
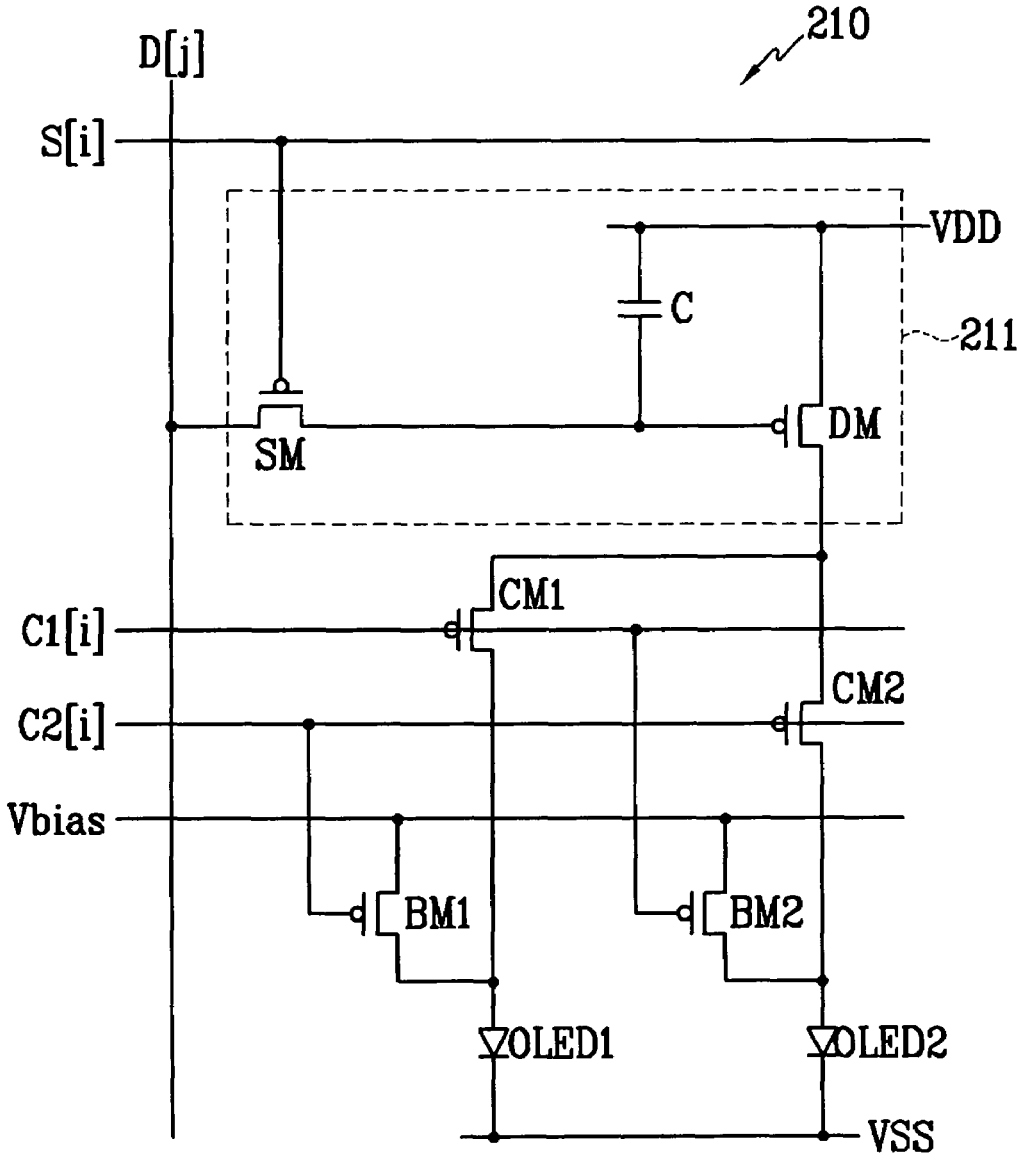
FIG. 6 is a circuit diagram of an equivalent circuit of a pixel of the OLED display of FIG. 5.

FIG. 6 is a circuit diagram of an equivalent circuit of the pixel 210 of the OLED display according to the second exemplary embodiment of the present invention.

As shown in FIG. 6, the pixel 210 includes a pixel driver 211, OLED1 and OLED2, transistors CM1 and CM2 for controlling OLED1 and OLED2 to selectively emit light, and transistors BM1 and BM2 for controlling OLED1 and OLED2 to be selectively reverse biased. A configuration of the pixel driver 211 is the same as the configuration of the pixel driver 111 according to the first exemplary embodiment of the present invention.

The transistor CM1 having a source coupled to a drain of the transistor DM, a drain coupled to an anode of the OLED1, and a gate coupled to the light emission control line C1[i] is turned on in response to a light emission control signal transmitted through the light emission control line C1[i], and transmits a current outputted by the transistor DM to the anode of the OLED1. The transistor CM2 having a source coupled to the drain of the transistor DM, a drain coupled to an anode of the OLED2, and a gate coupled to the light emission control line C2[i] is turned on in response to the light emission control signal C2[i] to transmit the current outputted by the transistor DM to the anode of the OLED2.

The anodes of the OLED1 and OLED2 are respectively coupled to the drains of the transistors CM1 and CM2, and cathodes of the OLED1 and OLED2 are coupled to the reference voltage Vss that is less than the source voltage VDD.

The transistor BM1 having a drain coupled to the power source line Vbias supplying the bias voltage, a source coupled to the anode of the OLED1, and a gate coupled to the light emission control line C2[i] is turned on in response to a light emission control signal transmitted through the light emission control line C2[i], and transmits a leakage current supplied to the anode of the OLED1 to the power source line Vbias. The transistor BM2 having a drain coupled to the power source line Vbias supplying the bias voltage, a source coupled to the anode of OLED2, and a gate coupled to the light emission control line C1[i] are turned on in response to the light emission control signal C1[i] to transmit the leakage current supplied to the anode of the OLED1 to the power source line Vbias.

A method of driving the OLED display according to the second exemplary embodiment of the present invention is described below with reference to FIG. 7.

Figure 7:
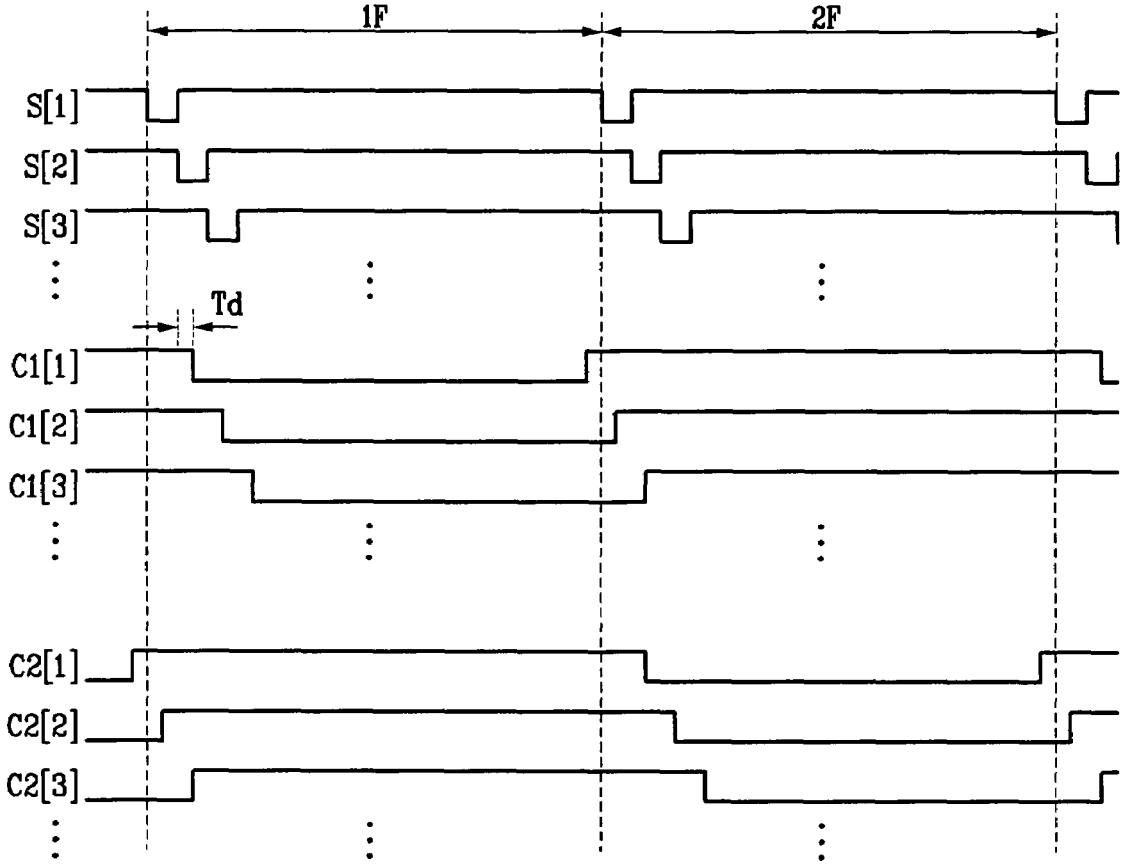
FIG. 7 is a signal timing diagram of the OLED display according to the second exemplary embodiment of the present invention.

FIG. 7 is a signal timing diagram of the OLED display according to the second exemplary embodiment of the present invention. The scan signal S[i] and the light emission control signal C1[i] and C2[i] supplied to the pixel 210 according to the second exemplary embodiment of the present invention are similar to those of the pixel 110 of FIG. 4 according to the first exemplary embodiment the present invention. However, there is a difference in that problems caused by a signal delay in the first exemplary embodiment of the present invention are solved in the second exemplary embodiment of the present invention since the light emission control signals C1[i] and C2[i] become a high level after a predetermined time td has passed when the scan signal S[i] changes to a high level from a low level.

In the first field 1F, while the low level scan signal is supplied to the scan line S[i], the transistor SM is in a turned-on state, and then a data voltage Vdata transmitted through the data line D[j] is supplied to the gate of the transistor DM (i.e., an end of the capacitor C). Therefore, a voltage corresponding to a difference between the source voltage VDD and the data voltage Vdata is stored in the capacitor C. In other words, a voltage VGS supplied between the gate and the source of the transistor DM is stored in the capacitor C, and the current IOLED corresponding to the stored voltage VGS flows though the drain of the transistor DM. When the light emission control signal C1[1] is at a low level after the low level scan signal S[1] has been supplied and the predetermined time td has passed, the transistor CM1 is turned on, the current IOLED flowing through the transistor DM is transmitted to the anode of the OLED1, and the OLED1 then emits light. The current of IOLED flowing through the OLED1 is given by Equation 1. When the light emission control signal C1[1] is at a low level in the first field 1F and the OLED1 is emitting light, the light emission control signal C2[1] remains at a high level. Accordingly, the current IOLED is not transmitted to the OLED2 because the transistor CM2 is turned off.

In the first field 1F, when the light emission control signal C1[i] is at a low level, the transistor BM2 is turned on. Accordingly, the OLED2 is reverse biased since a voltage lower than the voltage at the cathode of the OLED2 is supplied to the anode thereof. That is, since the inverse direction current flows to the OLED2, the space charges stored between the HTL and the EML or between the ETL and the EML of the OLED2 are discharged. Therefore, the lifetime of the OLED2 is increased.

In the second field 2F, when a low level scan signal is supplied to the scan line S[1], the transistor SM is turned on in a like manner of the first field 1F, and the data voltage Vdata supplied from the data line D[j] is supplied to the gate of the transistor DM (i.e., an end of the capacitor C). Therefore, a voltage corresponding to a difference between the source voltage VDD and the data voltage Vdata is stored in the capacitor C. In other words, a voltage VGS supplied between the gate and the source of the transistor DM is stored in the capacitor C, and the current IOLED corresponding to the charged voltage VGS flows though the drain of the transistor DM. When the light emission control signal C2[1] is at a low level after a low level scan signal S[1] has been supplied and the predetermined time td has passed, the transistor CM2 is turned on, the current IOLED flowing through the transistor DM is transmitted to the anode of the OLED2, and the OLED2 then emits light. In the second field 2F, while the light emission control signal C2[1] is at a low level and the OLED2 is emitting light, the light emission control signal C1[1] remains at a high level, the transistor CM1 is turned off, and accordingly, the current IOLED is not transmitted to the OLED1.

In the second field 2F, when the light emission control signal C2[i] is at a low level, the transistor BM1 is turned on. Accordingly, the OLED1 is reverse biased since a voltage that is less than the voltage at the cathode of the OLED1 is supplied to the anode thereof. That is, since the inverse direction current flows to the OLED1, the space charges stored between the HTL and the EML or between the ETL and the EML of the OLED1 are discharged. Therefore, the lifetime of the OLED2 is increased.

However, in the driving method according to the second exemplary embodiment of the present invention, the configuration of the OLED display can be complex and the aperture ratio can be reduced since the OLED display further includes the additional bias power source and bias power source lines.

An OLED display for reverse biasing the OLED without using an additional bias power source and bias power source lines according to a third exemplary embodiment of the present invention is described below with reference to FIG. 8.

Figure 8:
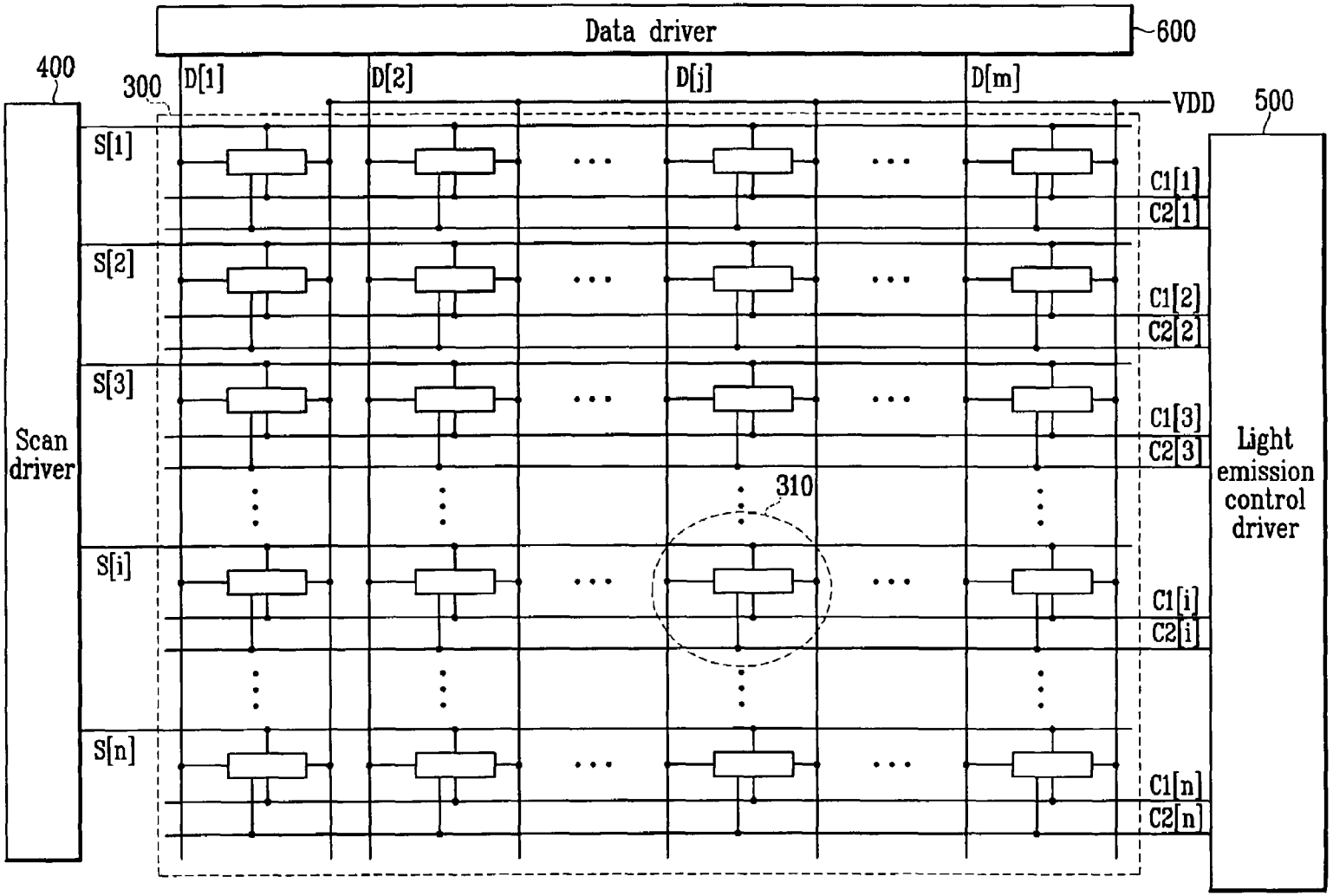
FIG. 8 is a top plan view of a configuration of the OLED display according to a third exemplary embodiment of the present invention.

FIG. 8 is a top plan view of a configuration of the OLED display according to the third exemplary embodiment of the present invention.

As shown in FIG. 8, the OLED display according to the third exemplary embodiment of the present invention includes a display panel 300, a scan driver 400, a light emission control driver 500, and a data driver 600. Hereinafter, operations of the scan driver 400, light emission control driver 500, and data driver 600 are the same as those according to the first exemplary embodiment of the present invention, and therefore detailed descriptions thereof have been omitted.

The display panel 300 includes a plurality of scan lines S[1] to S[n] and a plurality of light emission control lines C1[1] to C1[n] and C2[1] to C2[n] extending in a row direction, a plurality of data lines D[1] to D[m] and a plurality of power source lines VDD extending in a column direction, and a plurality of pixels 310. The pixel 310 operates by signals transmitted from the scan lines S[i], the light emission control lines C1[i] and C2[i], and the data lines D[j] such that two OLEDs time-divisionally emit light based on a data signal supplied from one data line D[j].

Figure 9:
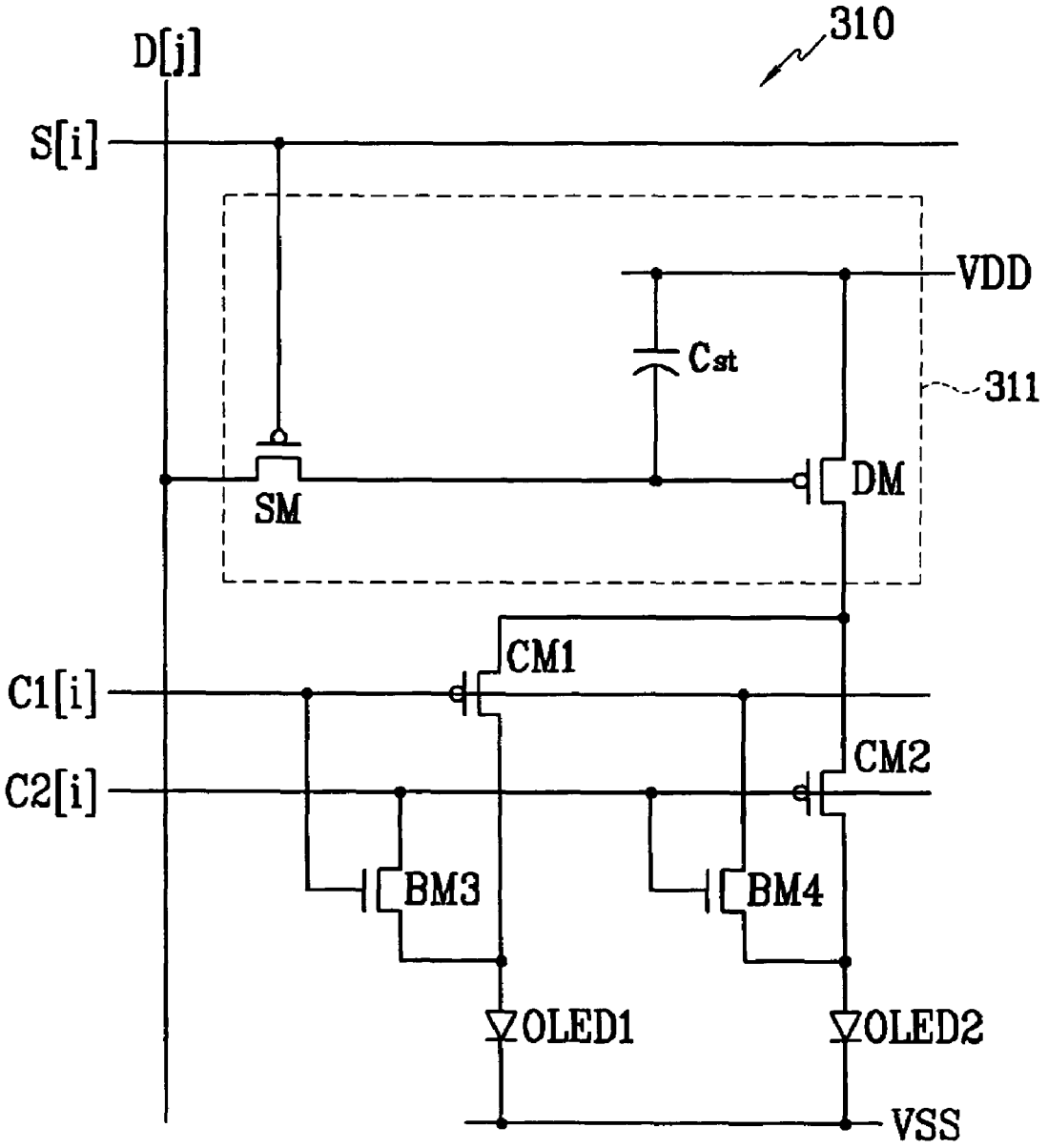
FIG. 9 is a circuit diagram of an equivalent circuit of a pixel of the OLED display of FIG. 8.

FIG. 9 is a circuit diagram of an equivalent circuit of the pixel of the OLED display according to the third exemplary embodiment of the present invention.

While the pixel driver includes two light emitting elements in the equivalent circuit for better understanding and ease of description, the pixel driver can include more than two light emitting elements in the exemplary embodiment of the present invention.

As shown in FIG. 9, the pixel 310 includes a pixel driver 311, OLED1 and OLED2, transistors CM1 and CM2 for controlling OLED1 and OLED2 to selectively emit light, and transistors BM3 and BM4 for controlling OLED1 and OLED2 to be selectively reverse biased.

Provided that a pixel driver is coupled to the scan line S[i] and data line D[j], and generates a current for supplying the OLED1 and OLED2 in response to the data signal transmitted through the data line D[j], the pixel driver can be used in the third exemplary embodiment of the present invention. In the third exemplary embodiment of the present invention, the pixel driver 311 having the same configuration as the pixel driver 111 according to the first exemplary embodiment of the present invention is used. That is, the pixel driver 311 includes two transistors and one capacitor (i.e., the transistor SM, the transistor DM, and the capacitor C).

The transistor CM1 having a source coupled to a drain of the transistor DM, a drain coupled to an anode of the OLED1, and a gate coupled to the light emission control line C1[i] is turned on in response to the light emission control signal transmitted from the light emission control line C1[i], and transmits the current outputted by the transistor DM to the anode of the OLED1. The transistor CM2 for controlling the light emission of the OLED2 has a source coupled to the drain of the transistor DM, a drain coupled to an anode of the OLED2, and a gate coupled to the light emission control line C2[i]. The transistor CM2 is turned on in response to the light emission control signal C2[i], and transmits the current outputted by the transistor DM to the anode of the OLED2.

The anodes of OLED1 and OLED2 are respectively coupled to the drains of the transistors CM1 and CM2, and the cathodes are coupled to the reference voltage Vss that is less than the source voltage VDD.

In addition, the transistor BM3 has a drain coupled to the light emission control line C2[i], a gate coupled to the light emission control line C1[i], and a source coupled to the anode of the OLED1. Therefore, the transistor BM3 is turned on in response to the light emission control signal transmitted through the light emission control line C1[i], and the leakage current of the OLED1 is transmitted to the light emission control line C2[i].

In a like manner, the transistor BM4 has a drain coupled to the light emission control line C1[i] and a gate coupled to the light emission control line C2[i], and a source coupled to the anode of the OLED2. Therefore the transistor BM4 is turned on in response to the light emission control signal transmitted through the light emission control line C2[i], and the leakage current of the OLED1 is transmitted to the light emission control line C1[i].

A current, which flows in a direction opposite to the current flowing during the light emission of the OLED must flow to OLED1 and OLED2 in order to eliminate the space charges stored between the HTL and the EML or between the ETL and the EML of the organic layer of the OLED, and therefore a voltage that is less than the reference voltage Vss is supplied to the anodes of OLED1 and OLED2. The low level voltage of the light emission control lines C1[i] and C2[i] is used for the voltage that is less than the reference voltage Vss.

While one pixel driver operates the two light emitting elements in the pixel of the OLED display shown in FIG. 9, one pixel driver can operate more than two light emitting elements in the light emitting display device according to the exemplary embodiment of the present invention. For example, one pixel driver can time-divisionally operate four light emitting elements, and in this case, one frame is divided into four fields.

That is, while the third exemplary embodiment of the present invention is supplied to the light emitting display device operating more than two light emitting elements, it has been described, for better comprehension and ease of description, that one pixel driver 311 operates two light emitting elements, and therefore, it is intended to cover various modifications and equivalent arrangements included within the spirit and scope of the appended claims.

A method of driving the OLED display according to the third exemplary embodiment of the present invention is described below with reference to FIG. 10.

Figure 10:
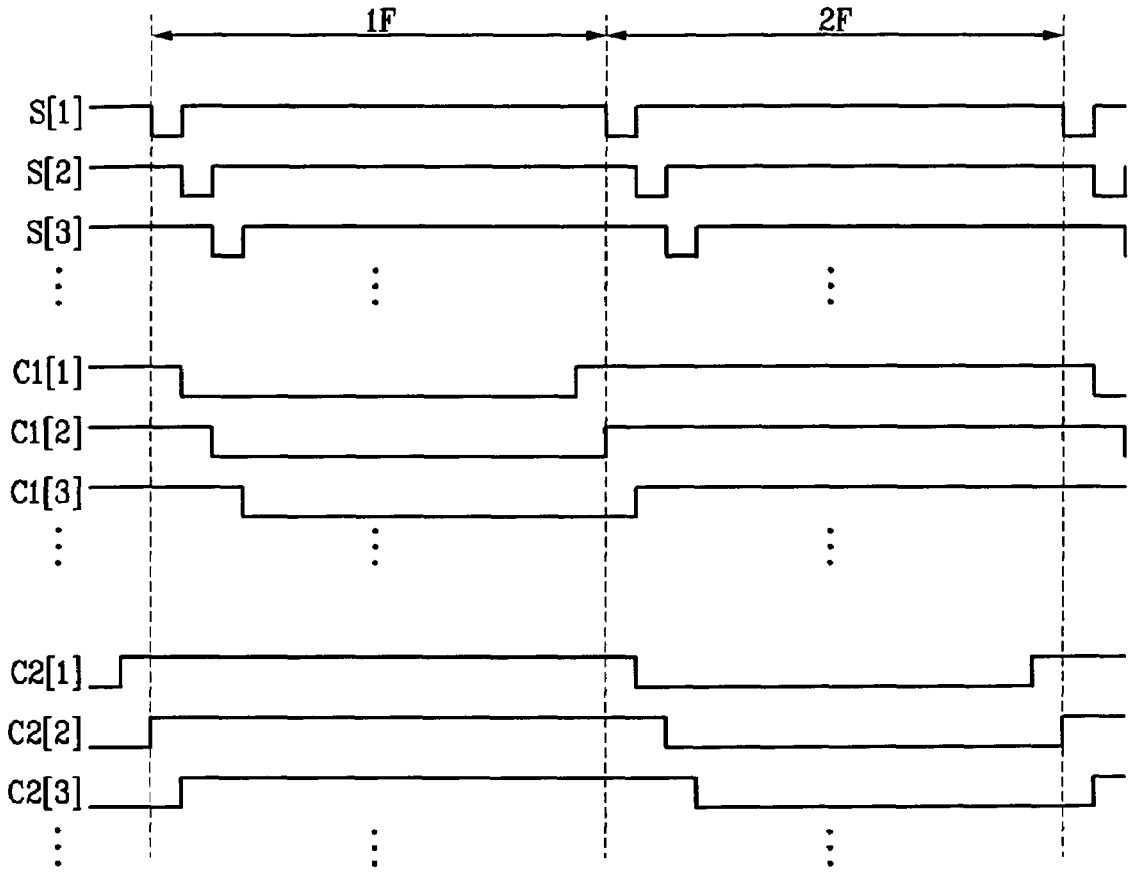
FIG. 10 is a signal timing diagram of the OLED display according to the third exemplary embodiment of the present invention.

FIG. 10 is a signal timing diagram of the OLED display according to the third exemplary embodiment of the present invention.

In the first field 1F, when a low level scan signal is supplied to the scan line S[1], the transistor SM is turned on, and then the data voltage Vdata supplied from the data line D[j] is supplied to the gate of the transistor DM and the capacitor C. Therefore, a voltage corresponding to a difference between the source voltage VDD and the data voltage Vdata is stored in the capacitor C. In other words, a voltage VGS supplied between the gate and the source of the transistor DM is stored in the capacitor C, and the current IOLED corresponding to the charged voltage VGS flows though the drain of the transistor DM.

When the light emission control signal C1[1] is at a low level, the current IOLED flowing through the drain of the transistor DM is transmitted to the anode of the OLED1, and then the OLED1 emits light corresponding to the current IOLED. The transistor BM3 remains turned off since the light emission control signal C1[1] is at a low level.

Also, since the light emission control signal C2[1] is at a high level, the transistor BM4 is turned on, the light emission control line C1[1] at a low level is coupled to the OLED2, and therefore the leakage current of the OLED2 flows to the light emission control line C1[1].

In the second field 2F, when the low level scan signal is supplied to the scan line S[1], the transistor SM is turned on in a like manner of the first field 1F, and the data voltage Vdata supplied from the data line D[j] is supplied to the gate of the transistor DM (i.e., an end of the capacitor C). Accordingly, a voltage corresponding to a difference between the source voltage VDD and the data voltage Vdata is stored in the capacitor C. In other words, a voltage VGS supplied between the gate and the source of the transistor DM is stored in the capacitor C, and the current IOLED corresponding to the charged voltage VGS flows though the drain of the transistor DM.

When the light emission control signal C2[1] is at a low level, the transistor CM2 is turned on, and the current IOLED flowing through the drain of the transistor DM is transmitted to the anode of the OLED2. The OLED2 then emits light corresponding to the current IOLED. The transistor BM4 remains turned off since the light emission control signal C2[1] is at a low level.

In addition, since the light emission control signal C1[1] is at a high level, the transistor BM3 is turned on and the light emission control line C2[1] at a low level is coupled to the OLED1, and therefore the leakage current of the OLED1 flows to the light emission control line C2[1].

With respect to the light emission control signal C1[i], in the first field 1F, when the light emission control signal C1[i] is at a low level, the transistor CM1 is turned on in response to the low level light emission control signal C1[i], and the current outputted by the transistor DM is transmitted to the anode of the OLED1. The transistor BM3 remains turned off when the light emission control signal C1[i] is at a low level.

In the second field 2F, when the light emission control signal C1[i] becomes a high level, the transistor CM1 is turned off and the transistor BM3 is turned on in response to the light emission control signal C1[i], and the light emission control line C2[i] is coupled to the anode of the OLED1. When the voltage at the light emission control line C2[i] becomes a low level voltage, the current reversely flows through the OLED1 to the light emission control line C2[i], in comparison with when the OLED1 is emitting light.

With respect to the light emission control signal C2[i], in the first field 1F, when the light emission control signal C2[i] is at a high level, the transistor CM2 is turned off and the transistor BM4 is turned on in response to the high level light emission control signal C2[i], and the light emission control line C1[i] is coupled to the anode of the OLED2. When the voltage of the light emission control line C1[i] becomes a low level voltage, the current reversely flows through the OLED2 to the light emission of the OLED2, in comparison with when the OLED2 is emitting light.

In the second field 2F, when the light emission control signal C2[i] becomes a low level, the transistor BM4 is turned off and the transistor CM2 is turned on in response to the light emission control signal C2[i], and the current outputted by the transistor DM is transmitted to the anode of the OLED2.

In other words, the transistor BM3 is turned off when the transistor CM1 is turned on by the light emitting signal C1[i], and the transistor BM3 is turned on when the transistor CM1 is turned off by the light emitting signal C1[i]. In a like manner, the transistor BM4 is turned off when the transistor CM2 is turned on by the light emitting signal C2[i], and the transistor BM4 is turned on when the transistor CM2 is turned off by the light emitting signal C2[i].

Different types of transistors are used as the transistors CM1 and CM2 and the transistors BM3 and BM4, so that the transistors CM1 and CM2 and the transistors BM3 and BM4 can operate differently in response to the same signal. In further detail, a p-type Thin Film Transistor (TFT) can be used for the transistors CM1 and CM2, and an n-type TFT can be used for the transistors BM3 and BM4.

As described, in the OLED display according to the third exemplary embodiment, the space charges stored between the HTL and the EML or between the ETL and the EML of the OLED are discharged since the OLED2 is reverse biased when the OLED1 emits light, and the OLED1 is reverse biased when the OLED2 emits light. Therefore, the lifetime of the OLED is increased.

In addition, in the OLED display according to the third exemplary embodiment, when the light emitting element is not emitting light, the current is securely interrupted since the light emitting element is reverse biased. Therefore, a contrast ratio is increased by removing the possibility of the light emission of the light emitting element.

Furthermore, in the OLED display according to the third exemplary embodiment, the aperture ratio of the light emitting display panel is increased because an additional power source and power source line for the reverse biasing are unnecessary since the low level voltage of the light emission control line C2[1] is used for the reverse bias power source for the OLED1, and the low level voltage of the light emission control line C1[1] is used for the reverse bias power source for the OLED2.

In the same way as in the second embodiment of the present invention, a signal waveform supplied to the OLED display according to the third exemplary embodiment of the present invention may be modified from the above described one so as to eliminate the adverse effect caused by the signal delay. In more detail, the OLED display according to the third exemplary embodiment of the present invention may be driven by a modified signal waveform in which the light emission control signal C1[i] or C2[i] becomes a high level when a predetermined time td has passed after the scan signal S[i] changed to a high level from the low level.

While the voltage programming OLED display has been described in the exemplary embodiments of the present invention, the present invention can also cover a current programming OLED display.

According to an exemplary embodiment of the present invention, the aperture ratio is increased since the arrangement of elements in a pixel is simplified by sharing the scan line and pixel driver between the plurality of subpixels.

In addition, according to the present invention, since the OLED is reverse biased for a predetermined time, the space charges stored between the HTL and the EML or between the ETL and the EML of the organic layer are discharged, and the lifetime of the OLED is increased. Also, the contrast ratio is increased since the current is appropriately interrupted in the light emitting element by the reverse bias.

While the present invention has been described in connection with what is presently considered to be practical exemplary embodiments, it is to be understood that the present invention is not limited to the disclosed embodiments, but, on the contrary, is intended to cover various modifications and equivalent arrangements included within the spirit and scope of the appended claims.

What is claimed is:

1. A light emitting display panel, comprising:

a plurality of first signal lines adapted to transmit a first signal;

a plurality of second signal lines and a plurality of third signal lines adapted to transmit a second signal and a third signal, respectively;

a plurality of fourth signal lines adapted to transmit a fourth signal, the plurality of fourth signal lines being arranged to cross the first signal lines, the second signal lines, and the third signal lines; and a plurality of pixels, each pixel corresponding to a crossing point of the first signal lines and the fourth signal lines, each pixel including:

a pixel driver adapted to output a first current corresponding to the fourth signal in response to the first signal;

a first light emitting element adapted to selectively emit light corresponding to the first current outputted from the pixel driver in response to the second signal;

a second light emitting element adapted to selectively emit light corresponding to the first current outputted from the pixel driver in response to the third signal independent of the second signal, the first and second light emitting elements emitting light independently of each other;

a first switch adapted to control the first current outputted from the pixel driver to the first light emitting element in response to the second signal;

a second switch adapted to control the first current outputted from the pixel driver to the second light emitting element in response to the third signal;

a third switch adapted to control a second current outputted from the first light emitting element to the third signal line in response to the second signal; and a fourth switch adapted to control the second current outputted from the second light emitting element to the second signal line in response to the third signal.

2. The light emitting display panel of claim 1, wherein:

the first light emitting element comprises a first electrode electrically coupled to the first and third switches, and a second electrode electrically coupled to a first reference voltage;

the second light emitting element comprises a first electrode electrically coupled to the second and fourth switches, and a second electrode electrically coupled to the first reference voltage;

the second signal is adapted to output a first level to turn on the first switch and a second level to turn on the third switch;

the third signal is adapted to output the first level to turn on the second switch and the second level to turn on the fourth switch; and the first level of the second and third signals is less than the first reference voltage.

3. The light emitting display panel of claim 2, wherein the first level of the second and third signals is less than the second level of the second and third signals.

4. A light emitting display device, comprising:

a plurality of scan lines adapted to transmit a scan signal;

a plurality of first light emission control lines and a plurality of second light emission control lines adapted to transmit a first light emission control signal and a second light emission control signal, respectively;

a plurality of data lines adapted to transmit a data signal, the plurality of data lines being arranged to cross the scan lines, the first light emission control lines, and the second light emission control lines;

a plurality of pixels respectively corresponding to crossing points of the scan lines, the first light emission control lines, the second light emission control lines, and the data lines;

a scan driver adapted to transmit the scan signal to the scan lines;

a light emission control driver adapted to transmit the first light emission control signal and the second light emission control signal, respectively, to the first light emission control lines and the second light emission control lines, respectively; and a data driver adapted to transmit the data signal to the data lines;

wherein each pixel includes:

a pixel driver adapted to output a first current corresponding to the data signal in response to the scan signal;

a first light emitting element adapted to selectively emit light corresponding to the first current outputted from the pixel driver in response to the first light emission control signal;

a second light emitting element adapted to selectively emit light corresponding to the first current outputted from the pixel driver in response to the second light emission control signal;

a first switch adapted to control the first current outputted from the pixel driver to the first light emitting element in response to the first light emission control signal;

a second switch adapted to control the first current outputted from the pixel driver to the second light emitting element in response to the second light emission control signal;

a third switch adapted to control a second current outputted from the first light emitting element to the second light emission control line in response to the first light emission control signal; and a fourth switch adapted to control the second current outputted from the second light emitting element to the first light emission control line in response to the second light emission control signal.

5. The light emitting display device of claim 4, wherein:

the first light emitting element comprises a first electrode electrically coupled to the first and third switches, and a second electrode electrically coupled to the first reference voltage;

the second light emitting element comprises a first electrode electrically coupled to the second and fourth switches, and a second electrode electrically coupled to the first reference voltage;

the second signal is adapted to output a first level to turn on the first switch and a second level to turn on the third switch;

the third signal is adapted to output the first level to turn on the second switch and the second level to turning on the fourth switch; and the first level of the second and third signals is less than the first reference voltage.

6. The light emitting display device of claim 5, wherein the first level of the second and third signals is less than the second level of the second and third signals.

7. The light emitting display device of claim 4, wherein:

the first switch comprises a first transistor having a gate electrically coupled to the second signal line and a source electrically coupled to the pixel driver;

the second switch comprises a second transistor having a gate electrically coupled to the third signal line and a source electrically coupled to the pixel driver;

the third switch comprises a third transistor having a gate electrically coupled to the second signal line and a drain electrically coupled to the third signal line; and the fourth switch comprises a fourth transistor having a gate electrically coupled to the third signal line and a drain electrically coupled to the second signal line.

8. The light emitting display device of claim 7, wherein the first and second transistors comprise p-type transistors and the third and fourth transistors comprise n-type transistors.

9. A light emitting display panel, comprising:

a plurality of scan lines adapted to transmit a scan signal;

a plurality of first light emission control lines and a plurality of second light emission control lines adapted to transmit a first light emission control signal and a second light emission control signal, respectively;

a plurality of data lines adapted to transmit a data signal, the plurality of data lines being arranged to cross the scan lines, the first light emission control lines, and the second light emission control lines; and a plurality of pixels corresponding to crossing points of the scan lines, the first light emission control lines, the second light emission control lines, and the data lines, respectively;

wherein each pixel includes:

a pixel driver adapted to output a first current corresponding to the data signal in response to the scan signal;

a first light emitting element adapted to selectively emit light corresponding to the first current outputted from the pixel driver in response to the first light emission control signal;

a second light emitting element adapted to selectively emit light corresponding to the first current outputted from the pixel driver in response to the second light emission control signal;

a first transistor having a gate electrically coupled to the first light emission control line, a source electrically coupled to the pixel driver, and a drain electrically coupled to the first light emitting element;

a second transistor having a gate electrically coupled to the second light emission control line, a source electrically coupled to the pixel driver, and a drain electrically coupled to the second light emitting element;

a third transistor having a gate electrically coupled to the first light emission control line, a drain electrically coupled to the second light emission control line, and a source electrically coupled to the first light emitting element; and a fourth transistor having a gate electrically coupled to the second light emission control line, a drain electrically coupled to the first light emission control line, and a source electrically coupled to the second light emitting element.

10. The light emitting display panel of claim 9, wherein:

the first current flows from the pixel driver to the first light emitting element in response to the first transistor being turned on; and the second current flows from the first light emitting element to the second light emission control line in response to the third transistor being turned on.

11. The light emitting display panel of claim 9, wherein:

the first current flows from the pixel driver to the second light emitting element in response to the second transistor being turned on; and the second current flows from the second light emitting element to the first light emission control line in response to the fourth transistor being turned on.

12. The light emitting display panel of claim 10, wherein:

the first and third transistors are not turned on concurrently; and the second and fourth transistors are not turned on concurrently.

13. The light emitting display panel of claim 9, wherein the first and second transistors comprise p-type transistors, and the third and fourth transistors comprise n-type transistors.

14. A method of driving a light emitting display device, the driving method comprising:

transmitting a first signal with a plurality of first signal lines;

transmitting a second signal and a third signal with a plurality of second signal lines and a plurality of third signal lines, respectively;

transmitting a fourth signal with a plurality of fourth signal lines, the plurality of fourth signal lines being arranged to cross the first, second, and third signal lines;

providing a plurality of pixels, each having a first light emitting element and a second light emitting element, the pixels each corresponding to an area where the first and fourth signal lines cross:

controlling a first current corresponding to the fourth signal transmitted to the first light emitting element to emit light in response to the second signal;

controlling a second current to transmitted from the first light emitting element to third signal lines in response to the third signal;

controlling the first current corresponding to the fourth signal transmitted to the second light emitting element to emit light in response to the third signal independent of the second signal, the first and second light emitting elements emitting light independently of each other; and controlling the second current transmitted from the second light emitting element to the second signal lines in response to the second signal.

15. The driving method of claim 14, further comprising:

controlling the first and second currents in response to the second signal during a first period; and controlling the first and second currents in response to the third signal during a second period.

* * * * *